United States Patent [19]

Tidwell

[11] 3,963,240

[45] June 15, 1976

[54] AIMING AND SCORING ATTACHMENT FOR PITCHBACK NETS

[76] Inventor: Lynn W. Tidwell, 3056 Quincy, Ogden, Utah 84403

[22] Filed: Feb. 12, 1975

[21] Appl. No.: 549,137

[52] U.S. Cl. ..... 273/102.1 C; 273/102 S; 273/102.1 B; 273/26 A; 273/181 J; 273/181 K; 273/183 R

[51] Int. Cl.[2] ..... A63B 71/00

[58] Field of Search ..... 273/26 R, 26 A, 29 B, 273/181 R, 181 A, 181 F, 181 J, 181 K, 183 R, 102 AP, 102 R, 102 S, 102.1 R, 102.1 B, 102.1 C

[56] References Cited

UNITED STATES PATENTS

| | | | |
|---|---|---|---|
| 2,915,314 | 12/1959 | Phillips | 273/26 A |
| 3,197,208 | 7/1965 | Makar | 273/26 A |
| 3,411,784 | 11/1968 | Lawrence | 273/102 AP |
| 3,672,672 | 6/1972 | Rubin | 273/26 A |
| 3,706,451 | 12/1972 | Dixon | 273/26 A |

*Primary Examiner*—Richard C. Pinkham
*Assistant Examiner*—Marvin Siskind
*Attorney, Agent, or Firm*—Boniard I. Brown

[57] ABSTRACT

A scoring attachment for a pitchback net of conventional elastic-panel construction provides a mounting bar spaced from the rear face of the panel, and a plurality of target-bearing arms pivoted on the mounting bar. Each of said targets—suitably four in number and marked with the number of hits possible in accord of the rules of baseball, one through four—is faced with a circular aiming disk and is spaced from the mounting bar to provide clearly separate aiming points for a player; each target is also provided with an audible annunciator—suitably a gong—to indicate impact of a ball with sufficient energy to deform the elastic panel against the target and is further provided with spring means urging it into a rest position in a plane parallel to the elastic panel and in line with the location of the mounting bar.

16 Claims, 6 Drawing Figures

AIMING AND SCORING ATTACHMENT FOR PITCHBACK NETS

BACKGROUND OF THE INVENTION

1. Field of the Invention

The invention relates to a training aid for baseball pitchers. It relates, more particularly, to an aiming and scoring device for use with a pitchback net.

2. Prior Art

Pitchback nets conventionally consist of a resilient sheet elastically suspended in the aperture of a substantially rectangular rigid frame and provided with support means allowing the frame to be placed on the ground at an angle with the vertical. A player uses such a pitchback device by propelling a baseball against its surface with a velocity vector calculated to cause the ball to rebound into the vicinity of the player's hands. The use of such a net tends to inculate in the player the proper speed and direction of ball to result in a returned ball which can be caught by him and then rethrown.

Because of the substantially large surface area over the net which will result in a proper return, the pitchback net does not, by itself, train a pitcher to be particularly accurate in projecting the ball. Moreover, the pitchback net constitutes in essence a one-man game and competitive scoring of achievement for two or more persons is not possible.

It is, therefore, a primary object of the invention to provide an attachment for pitchback nets which will permit indication of a ball thrown accurately at a particular area of the net.

It is a further aim of the invention to provide in such a device means for adjusting the indicator provided to be responsive to different kinetic energies of the impacting ball, thereby permitting adjustment to players of varying ages and strengths.

It is yet another object of the invention to provide a plurality of aiming points, or targets, of the kind described.

It is yet a further object of the invention to provide scoring indices associated with each of the aforementioned plurality of aiming points, thereby allowing for the attachment to be used as part of a competitive game, scored on the basis of accurately projected balls by the several players.

It is also an object of the invention to teach the construction of attachments of the type described which is economical to produce, simple to attach to conventional pitchback nets, and easy to adjust to respond to differing distortions of the net.

It is a further object of the invention to provide, as an article of commerce, kits for the conversion of conventional pitchback nets, including an attachment with plural aiming points as described hereinabove and gameboard means for scoring the game played on said net with the aid of said attachment.

SUMMARY OF THE INVENTION

The invention attains its objects, and other objects and advantages which will become apparent from the detailed description of the preferred embodiment thereof below, by providing a mounting bar—preferably tubular in nature— which may be secured to the support frame of a conventional pitchback net.

The mounting bar is arranged to run transverse to the rear face of the net in an alignment substantially parallel to the ground in the erect position of the net, when the attachment is secured to the braces of the support frame. Other embodiments may be secured to the peripheral frame of the net proper and run at arbitrary alignments, including the vertical, with respect to the ground plane.

Pivoted on said mounting bar, a plurality of target-bearing arms—preferably four in number—are spaced at predetermined intervals. Each of said arms is provided with a fixed stop and spring means urging it against that stop which locates it in a plane parallel to the back face of the pitchback net in the steady-state condition, and which permits a pivotal motion of the arm rearwardly with respect to the net when the latter is struck by a ball with sufficient force to deform the net into the aforementioned parallel plane.

The target at the end of each arm, which may be of the same or differing lengths, comprises a circular aiming disk and an annunciator. The aiming disk may be marked with a scoring index differing for each of the targets, may be differentiated by color or design, or, where a competitive game is not to be played, may be left blank and colored to provide a contrast with the net and the backgrounds conventionally encountered.

The annunciator associated with each target is a bell or gong, so arranged that impact of the net and ball against the face of the aiming disk will result in an audible signal as the target pivots rearwardly on the mounting arm.

In the preferred embodiment of the invention, described below with reference to the accompanying drawing, the targets are four in number and marked with the numerals one through four, or with a legend indicating 'Home Run' in the place of the numeral four. The game is then played by an arbitrary number of players, divided into two competing teams, according to modified rules of baseball. Each ball thrown against a target with sufficient force to energize the annunciator associated therewith scores as if a batter had a hit commensurate with the index marked thereon. A game board may be provided with sockets for scoring pins arranged around the outline of a baseball diamond which permits the movement of such pins around the diamond from plate to plate in response to the achieved score. Any projected ball which does not result in proper impact on a target is considered a 'strike' and a player may be 'struck' out after the appropriate number of failures to score by hitting one of the targets.

Additional rules may be elaborated, such as that a ball striking the peripheral frame of the pitchback net be considered a 'foul' ball, and so on.

BRIEF DESCRIPTION OF THE DRAWINGS

The preferred embodiment of the invention is illustrated in the drawing, in which.

DESCRIPTION OF THE PREFERRED EMBODIMENT

Figures 1, 2, 3, 4, 5, 6:
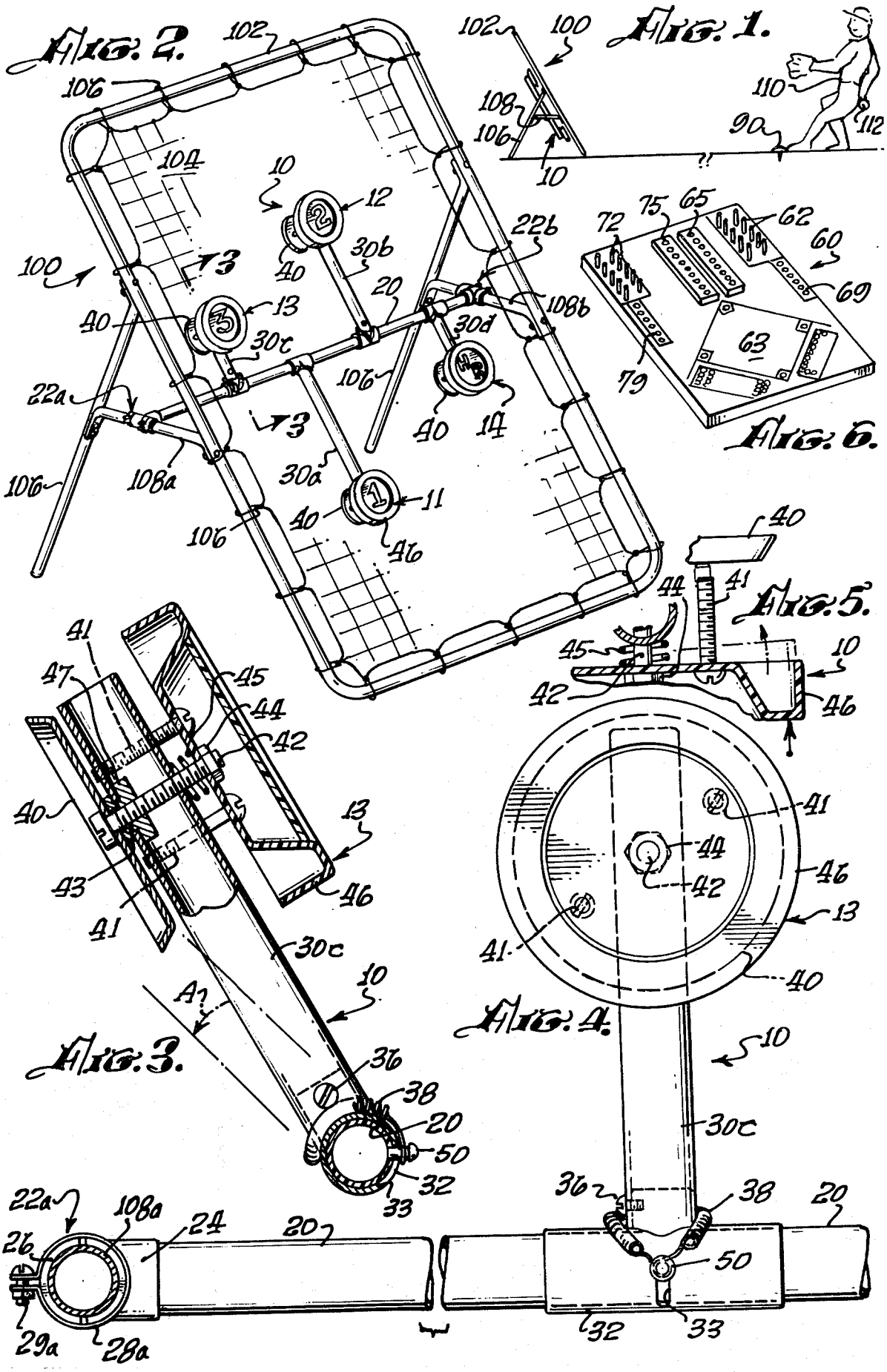
FIG. 1 is a schematic elevation of a game situation utilizing a pitchback net with a scoring attachment according to the invention.
FIG. 2 is a perspective view of the pitchback net and attachment.
FIG. 3 is a partial, transverse section through the mounting bar of the attachment of FIG. 1, illustrating the construction and mounting of a particular target arm thereof.
FIG. 4 is a partial frontal view of the target arm of FIG. 3, its pivot on the mounting bar, and of one securing clamp of the latter engaging a brace of the pitchback net.
FIG. 5 is a fragmentary section through the aiming disk and bell of the target arm of FIG. 4.
FIG. 6 is a perspective view of a scoring board as may be utilized in conjunction with the attachment of the invention to keep track of the simulated baseball game played therewith by two competing teams, each of one or more players.

The schematic elevation of FIG. 1 shows a pitchback device 100 and a player 110 about to project a ball 112 against the pitchback device. The device 100 is equipped with an aiming and scoring attachment 10 of the invention, mounted behind the resilient net in the face thereof. A rubber stop 90 defines the appropriate pitching distance of the player 110 with respect to the pitchback device.

The perspective view of FIG. 2 details the construction of the pitchback device 100 and the aiming and scoring device 10. The pitchback device comprises an upright, substantially rectangular frame 102, across the aperture of which is stretched an elastic panel 104—constructed from an open net, or mesh, resembling a fishing net and conventionally knotted from a filament of great strength and elasticity—secured to the frame 102 by means of a large number of spring loops 106. The spring loops 106 may be mechanical springs or, according to the illustration of FIG. 2, may be rubber loops passed around the frame and engaging the edges of the pitchback panel 104.

The frame 102, and its coplanar pitchback panel 104, are held in an alignment angled with respect to the vertical by means of legs 106 and cross-braces 108 affixed to the legs and to the frame 102, typically a cross-brace 108*a* at the left side of the frame, as seen from the vantage point of the player 110.

The aiming and scoring device 10 includes a mounting bar 20 and clamps 22*a* and 22*b* secured to either end of the mounting bar for engaging the cross-braces 108. By appropriately positioning the clamps 22 on the cross-braces 108 the mounting bar is fixed in a plane parallel to, and rearwardly displaced from, the plane of the elastic panel 104.

Four targets—11, 12, 13 and 14—marked with the numerals 1, 2, 3 and with the initials HR—indicating home run—respectively, are pivotably attached to the mounting bar 20 of the device 10. The targets, or more properly their pivot arms 30, are so attached to the mounting bar that targets 12 and 13 project above the mounting bar, while targets 11 and 14 depend from it. This arrangement is somewhat arbitrary and is designed, in conjunction with the differential lengths of the several pivot arms 30, to distribute the targets over the critical rebound surface of the pitchback panel 104. This critical area is defined by the tendency of the panel 104 to return a ball thrown against it toward the thrower and excludes a narrow border around the periphery of the panel, or net, 104 where the nearness of the frame 102 would bias the return direction.

The fragmentary, transverse section of FIG. 3 illustrates the detail construction of a typical target 13 and its pivot arm 30*c*. The pivot arm 30*c* is a tubular member which is drilled in a plane orthogonal to the plane of the panel 104 to receive a mounting screw 42 which retains a gong 40—spaced from the pivot arm 30*c* by washer 43—rigidly against the pivot arm. The mounting screw 42 engages a barrel nut 47 which nestles into the aforementioned drilled hole; the length of the screw 42 is substantially in excess of the diameter of the arm 30*c* and a spring 45 is entrapped on the protruding, free end of the screw prior to receiving target 46 and a nut 44. The spring 45 provides a resilient seat for the target dish and permits it to move rearwardly, towards the pivot arm 30*c*, when struck by a ball. A plurality of striker pins 41—machine screws of the proper length—are held in the target dish and provide the means for sounding the gong 40 upon contact of the dish with a ball. The center portion of the target dish 46 is faced with the target 13, preferably a circular cover bearing the scoring index—representing the three bases for the example target—associated with the assembly.

The target dish is suitably molded from a flexible plastic composition; the flexibility of the dish reinforces the resiliency of the spring-loaded mounting of the target on the pivot arm 30*c* and insures that the gong will be sounded on all appropriate impacts.

FIG. 3 also illustrates the pivot assembly of pivot arm 30*c*, with respect to the mounting bar 20. The mounting bar is suitably a cylindrical shaft, or tubular member of some rigidity. The pivot arm is secured, by means of a screw 36 to the side member of a reducing outlet T-fitting 32, or an analogous machined or molded part, the run of which is a sliding fit on the outer diameter of the mounting bar 20. A slot 33, aligned with the axis of the pivot arm 30, is machined through the wall of the fitting 32 and a pin 50 is passed through the slot to engage the wall of the mounting bar.

The slot 33 cooperates with the pin 50 to define a range of pivotal travel, represented by the arrow 'A', between a forward position of the pivot arm and a rearward position, towards which the arm may be impelled by a ball striking the target 13 at its end. A collar spring 38 completes the assembly; it is looped around the shoulder of the fitting 32, or the lower end of the pivot arm 30, and both ends are engaged on the pin 50. The spring ensures that, in the absence of external forces, the pivot arm will always bear against the pin 50 with the upper end of the slot 33, representing its forward position.

FIG. 4 is another partial view of the attachment 10, showing the target 13 in elevation and one of the clamps, 22*a*, securing the mounting bar 20 to brace 108*a*.

The clamp 22 is readily formed by sawing the run of a T-fitting along its diameter orthogonal to the axis of the side outlet; the resulting saddle-piece 24 is attached to the end of mounting bar 20 and is clamped, in conjunction with the semi-tubular remainder 26 of the original T-fitting, against the outer diameter of brace 108*a*. The actual clamping forces are developed by a pair of clamp bands 28, of which the forward clamp 28*a* is visible, along with its fastener 29*a*.

While FIGS. 3 and 4 represent the construction of the pivot arm assemblies associated with target 13, the remaining targets 11, 12 and 14 are constructed in an analogous manner and pivoted from the mounting bar identically to the details of these Figures. Similarly the right-hand clamp assembly 22*b* is similar, in all details, to the left-hand assembly 22*a* and engages right side brace 108*b* in the same manner.

The deformation of typical target 13 under the impact of a ball striking the pitchback panel 104 immediately in front of the target is illustrated in the fragmentary section of FIG. 5.

The action of the aiming and scoring device 10 may now be recapitulated with reference to the drawing: a player 110 impels a ball 112 against the pitchback panel 104 of a pitchback device 100, attempting to aim the ball in such a manner that it will impact over one of the targets of the device 10 which are visible to him through the open mesh of the pitchback panel; in the event that the player is successful in aiming the ball 112 into the right alignment, the panel 104 deforms ahead of the ball and contacts the face of the target, as typified by reference numeral 13, causing the associated target dish 46 to move back against spring 45 and, possibly, to deform itself under the imposed load; the motion and/or deformation of the target dish 46 then causes one or more of the striker pins 41 mounted thereon to come into contact with a gong 40 and to provide an audible announcement of the successful aim of the ball 112; the forces deforming the spring 45 are transmitted into the pivot arm 30*c* and cause it to deflect rearwardly against the tension of collar spring 38; when all the forward kinetic energy of the ball has been converted into stored energy of the pitchback panel 104, the ball is accelerated toward the player 110 by the rebound of the panel and the pivot arm 30*c* is released to move forward, urged by the spring 38; at the completion of the motion all parts of the combined pitchback device and of the aiming and scoring attachment are in their original positions and ready to receive the ball 112 anew.

When the device is used by a single player, purely in a training mode, the proper method is to select a particular target which the player wishes to strike and to keep throwing the ball until that target is struck with a reasonable frequency. Because each target occupies only a small portion of the critical rebound surface of the pitchback net the probability that any number of hits will result from poorly aimed balls is slight and the required 'positive' feedback, the ringing of the gong, quickly alerts the player that he is on the right track in terms of stance and aiming technique.

It is also foreseen that players of various ages and physical strengths may use the attachment; it is readily adjustable as to the force required to sound the annunciator by loosening the clamps 29 at the side braces 108 and bodily moving the attachment closer, for a lower impact force to sound the bell, or farther, for a higher impact to score, with respect to the pitchback panel.

It is also possible to improve the differentiation between successive impacts on different targets by tuning the gongs, or bells, associated with the several targets at different frequencies. This feature may be of particular advantage when the attachment is used in a competitive game; disputes over which target had been hit are more readily resolved when visual confirmation is reinforced by audible differences.

To play a competitive game a gameboard 60, depicted in the perspective view of FIG. 6, may be used in conjuction with the attachment 10. The gameboard 60 bears a representation 63 of a baseball diamond with first, second, third and home bases clearly marked. Depressions in the board accomodate a plurality of scoring pins 62 of one color and a similar group of scoring pins 72 of another color; further differentiation between pins of either color may be made by design or numerical designation.

When the two competing teams play, a pin representing one side is placed at home plate and a player of that side begins to pitch his ball at the pitchback device. If he scores, his pin is moved around to the base represented by the number of runs marked on the target he has impacted his ball against. Successive players of the same team may also follow up the first player and the pins of each are moved, in succession, the designated number of 'hits' until those which return to the home plate are placed in the appropriate scoring region, 65 or 75, associated with their team. Players who fail to score in three pitches at the panel 104 are 'out' and are moved into an appropriate inactive space, 69 or 79, in the game board and are out of the game for the particular inning.

The formal rules of baseball are followed as much as possible, reinterpreted to the circumstances of the scoring device. Foul balls are called when a ball is thrown in such a manner that it strikes the frame 102 of the pitchback device; balls which miss the net altogether are considered 'strikes' and counted towards the 'out' score of the player. In many respects the player is considered to be batting, rather than pitching, for the rules governing play.

In this manner a highly competitive game is provided for those interested in baseball, while also allowing for pitching training, since the aim of the players, to score as many home runs as possible, requires skill at pitching the ball into the panel surface immediately above the HR tag of target 14.

The invention has been described in detail with reference to a preferred embodiment; its parts are made from tubular sections and fitting commonly associated with piping or tubing, suitable high-density PVC plastic pipe and fittings. One skilled in the art of constructing outdoor game devices, once exposed to the teachings herein, may envisage changes in the mechanical details of the invention; such changes, including, but not restricted to, those listed below, are deemed to be encompassed by the disclosure of the invention, delimited only by the appended claims.

The substitution of bells for the gong plate; the use of non-tubular mounting bars and pivot bars; differential alignment of the mounting bar with respect to the pitchback panel; the mounting of the attachment directly to the peripheral frame; the use of materials and attachment methods other than those directly disclosed, and other alternatives shall be considered within the scope of the foregoing disclosure.

The inventor claims:

1. An aiming and scoring attachment for a baseball pitchback device comprising an open frame having a central opening therethrough, and elastically deflectable panel spanning said opening and secured about its perimeter to said frame, and means for supporting said frame in a generally upright position of use, wherein a ball may be thrown against the panel to deflect the panel rearwardly, whereby the elastic strain energy developed in the panel during rearward deflection thereof returns the panel forwardly to impel the ball back toward the thrower, said attachment comprising:

mounting means adapted to be secured to said pitchback device behind said panel, at least one arm pivoted on said mounting means for free swinging movement about a given axis, spring means for urging said arm in one direction of rotation about said axis, target means at the outer end of said arm including a target member mounted on the arm for extension in said one direction of rotation and retraction in the opposite direction of rotation relative to said arm, a spring for urging said target member in said one direction of rotation relative to the arm, and annunciator means actuated by retraction of said target member relative to the arm to produce a signal, and limit stop means for limiting swinging movement of said arm in said one direction of rotation to a normal position wherein said target member is disposed to be located adjacent the rear side of said panel and limiting swinging movement of said arm in said opposite direction of rotation to a retracted position in a manner such that impact of a ball with said panel opposite said target member deflects the panel rearwardly to actuate said annunciator means and drive said arm rearwardly toward its retracted position to permit sufficient deflection of the panel to return the ball toward the thrower.

2. The attachment of claim 1 wherein:

said mounting means comprises a bar, and means for securing said bar to said pitchback device in a position behind and parallel to said panel, and said arm is swingable about the longitudianl axis of said bar.

3. The attachment of claim 2 wherein:

said pitchback frame supporting means comprise frame members extending rearwardly from opposite sides of said frame, and said securing means comprises means for supporting the ends of said bar on said frame members for adjustment of said bar along said frame members, and means for clamping said bar in fixed position along said frame members.

4. The attachment of claim 1 wherein:

said attachment includes a plurality of said arms pivoted on said mounting means for swinging movement about and spaced along said axis, each arm mounting a target means, and the several arms being disposed in substantially a common plane parallel to said axis in said normal positions of the arms.

5. The attachment of claim 4 wherein:

certain arms extend to one side and other arms extend to the opposite side of said axis.

6. The attachment of claim 5 wherein:

one arm is longer than the remaining arms.

7. The attachment of claim 6 wherein:

said mounting means comprises a bar, and means for securing said bar to said pitchback device in a position behind and parallel to said panel, and said arm is swingable about the longitudinal axis of said bar.

8. The attachment of claim 7 wherein:

said pitchback frame supporting means comprise frame members exteding rearwardly from opposite sides of said frame, and said securing means comprises means for supporting the ends of said bar on said frame members for adjustment of said bar along said frame members, and means for clamping said bar in fixed position along said frame members.

9. In combination:

a baseball pitchback device comprising an open frame having a central opening therethrough, an elastically deflectable panel spanning said opening and secured about its perimeter to said frame, and means for supporting said frame in a generally upright position of use, wherein a ball may be thrown against said panel to deflect the latter rearwardly, whereby the elastic strain energy developed in the panel during rearward deflection thereof returns the panel forwardly to impel the ball back toward the thrower, aiming and scoring means mounted on said pitchback device behind said panel comprising mounting means secured to said device, at least one arm pivoted on said mounting means behind said panel for free swinging movement of the arm about an axis generally parallel to the plane of said panel, spring means for urging said arm forwardly toward said panel, target means at the outer end of said arm including a target member mounted on the arm for forward extension and rearward retraction relative to said arm, a spring for urging said target member forwardly relative to the arm, and actuator means actuated by rearward retraction of said target member relative to the arm to produce a signal, and limit stop means for limiting forward swinging movement of said arm toward said panel to a normal position wherein said target member is disposed adjacent the rear side of said panel and limiting rearward swinging movement of said arm away from said panel to a retracted position, in a manner such that impact of a ball with said panel opposite said target member deflects the panel rearwardly to actuate said annunciator means and drive said arm rearwardly toward its retracted position to permit sufficient deflection of the panel to return the ball toward the thrower.

10. The combination according to claim 9 wherein:

said mounting means comprises a bar, and means for securing said bar to said pitchback device in a position behind and parallel to said panel, and said arm is swingable about the longitudinal axis of said bar.

11. The combination according to claim 10 wherein:

said pitchback frame supporting means comprise frame members extending rearwardly from opposite sides of said frame, and said securing means comprises means for supporting the ends of said bar on said frame members for adjustment of said bar along said frame members, and means for clamping said bar in fixed position along said frame members.

12. The combination according to claim 9 wherein:

said attachment includes a plurality of said arms pivoted on said mounting means for swinging movement about and spaced along said axis, each arm mounting a target means, and the several arms being disposed in substantially a common plane parallel to said axis in said normal positions of the arms.

13. The combination according to claim 12 wherein:

certain arms extend to one side and other arms extend to the opposite side of said axis.

14. The combination according to claim 13 wherein:

one arm is longer than the remaining arms.

15. The combination according to claim 14 wherein:

said mounting means comprises a bar, and means for securing said bar to said pitchback device in a position behind and parallel to said panel, and said arm is swingable about the longitudinal axis of said bar.

16. The combination according to claim 15 wherein:

said pitchback frame supporting means comprise frame members extending rearwardly from opposite sides of said frame, and said securing means comprises means for supporting the ends of said bar on said frame members for adjustment of said bar along said frame members, and means for clamping said bar in fixed position along said frame members.

* * * * *